US006165084A

United States Patent [19]

Cranston

[11] Patent Number: 6,165,084

[45] Date of Patent: Dec. 26, 2000

[54] HOCKEY TRAINING DEVICE

[76] Inventor: Rene A. Cranston, 3409-64$^{th}$ Ave. SW., Seattle, Wash. 98116

[21] Appl. No.: 09/350,253

[22] Filed: Jul. 8, 1999

[51] Int. Cl.$^{7}$ ..... A63B 69/00

[52] U.S. Cl. ..... 473/422; 482/66; 280/818

[58] Field of Search ..... 473/415–422, 473/560, 570, 588, FOR 132; 482/66; 463/3; 280/1.5, 5.24, 835, 7.13, 7.1, 841, 600, 601, 818, 14.1

[56] References Cited

U.S. PATENT DOCUMENTS

| | | | |
|---|---|---|---|
| D. 301,906 | 6/1989 | Coolen | D21/199 |
| 3,695,609 | 10/1972 | Rothe | 482/66 |
| 4,005,859 | 2/1977 | Tait | 482/66 |
| 4,021,033 | 5/1977 | Auclair et al. | 482/66 |
| 4,491,320 | 1/1985 | Smith | 273/1 B |
| 5,087,060 | 2/1992 | Rogalski et al. | 280/14.1 |
| 5,226,821 | 7/1993 | Murphy et al. | 434/247 |
| 5,397,154 | 3/1995 | Baldwin | 280/818 |
| 5,647,747 | 7/1997 | Macri et al. | 434/247 |
| 5,816,945 | 10/1998 | Todd et al. | 473/425 |

FOREIGN PATENT DOCUMENTS

| | | | |
|---|---|---|---|
| 1305731 | 7/1992 | Canada | A63B 69/00 |

*Primary Examiner*—Jeanette Chapman
*Assistant Examiner*—Mitra Aryanpour
*Attorney, Agent, or Firm*—Garrison & Associates PS; David L. Garrison

[57] ABSTRACT

A hockey training device comprising a frame with skate-like and hockey stick-like members attached thereto, simulating an opposing player. This training device is intended to assist the novice hockey player in developing the skills associated with maneuvering the hockey puck around and/or through an opponent, and forces the novice to concentrate on the triangle presented by the skates and hockey stick of the opponent. The device consists of a frame supporting two downwardly disposed legs having skate-like elements attached, and a third leg having a stick-like element attached. The skate-like elements and stick-like elements have coplanar lower edges so that the entire device may be placed on the ice, resting on these edges. The frame may be weighted, and drag-inducing spikes may be incorporated into the skate-like elements to affect the motion of the device on the ice.

5 Claims, 3 Drawing Sheets

HOCKEY TRAINING DEVICE

FIELD OF INVENTION

The present invention relates generally to hockey practice and training equipment for improving technical skills, and more particularly to a hockey puck handling and training device for developing skills in getting the puck past an opponent.

BACKGROUND OF THE INVENTION

Puck handling is an important aspect of the game of hockey. Proficient puck-handling allows a hockey player to outmaneuver opponents while in control of the puck and to prevent an opponent from taking possession of the puck. Proficient puck-handling also helps hockey players to make better passes to teammates and to deliver better shots.

Because puck-handling is such an important part of the game of hockey, training exercises focusing on this aspect of the game have been performed since the game originated. A typical puck-handling training exercise, for example, consists of a player moving a puck quickly in a pre-determined pattern in front of the player. In teaching this training exercise, coaches frequently instruct their players to imagine the desired puck path on the playing surface, and to move the puck along that imaginary path, or alternatively place cones or some other device on the playing surface to define the desired path and then instruct the player moves the puck around the cones.

While these types of exercises are important and beneficial to developing puck-handling skills, they do not teach the player the specific skills associated with moving a puck around an opposing player. An important aspect of puck-handling skills is the ability to maneuver a puck around or through an opposing player. To establish one-on-one individual play competence, a hockey player must learn to maintain control of a puck while skating past an opposing player. The technique of moving the puck past an opposing player is often called 'attacking-the-triangle'. The triangle referred to is defined by imaginary lines connecting a defending player's two skates and his or her stick. A puck-handling player approaching an opponent has three basic options for bringing the puck around or through the opponent, as illustrated in FIG. 1. The puck-handler can take the puck swiftly around the left or right side of the opponent's skates and stick, the puck-handler can fake one way and then move the puck between the heel of the opponent's stick and in front of the toes of the opponent's skates and then shift to pick up the puck and continue on around the opponent on either side, or the puck handler can move the puck between the opponent's skates and around the defender on either side. Supplementing these three basic options, a player can use a combination of other fakes and maneuvers to beat the defensive player. The concept of attacking the triangle provides a concrete focus to assist the novice in learning this basic puck-handling skill.

Heretofore, teaching the technique of attacking the triangle typically required two hockey players, the puck handler and the defensive opponent. This teaching method is inefficient for instructing novice hockey players because it requires a second hockey player to act as an opponent to the player developing skills in attacking the triangle. If an unskilled player participates in the role of 'opponent' then poor movement or stick placement by such novice may negate much of the benefit of the exercise to the puck handler. On the other hand, if a skilled player or coach acts as the opponent it is an inefficient use of one-on-one instruction for this skill. Because puck handling is a skill that requires a lot of practice and repetition, it would be advantageous if most or all of the repetition drills could be performed alone by the individual learning the skill, without enlisting the help of a second player or coach.

Another disadvantage of attempting to learn this puck-handling skill with another player is that, when practicing or playing against a live person, novice hockey players and children in particular, tend to focus on the body of the opponent. Learning the skills required to attack the triangle requires that the player focus on the stick and skates of an opponent. Therefore, it is a disadvantage to have a live opponent, player or coach, because it distracts the attention of the student from the triangle formed by the skates and hockey stick of the opponent. It is also more difficult to acquire these skills against a live player because the novice is generally forced to deal with not only a moving puck but also a moving 'triangle'. It would be beneficial to the novice hockey player to have a stationary, or a more predictably movable, 'opponent' to initially practice these skills against.

SUMMARY

The present invention is directed to a device that satisfies the need for a hockey training device that assists in teaching novice hockey players the puck-handling skills required to maneuver a hockey puck past an opponent.

In particular, the present invention provides a hockey training device comprising a frame supporting three legs arranged in a triangular configuration. Two of these legs are each connected to a skate-like element for simulating the skates of an opponent, and the third leg member has a hockey stick-like component attached to it for simulating the bottom portion of the hockey stick of an opponent. The skate-like and stick-like components have coplanar bottom edges so that when the device is placed on a flat surface, such as an ice rink, the skate-like elements and the stick-like element simulate the lower portion of a hockey opponent allowing the trainee to practice the basic skills associated with attacking the triangle.

It is a further object of the present invention to provide such a training device that can be used by an individual hockey player, without requiring a second hockey player's assistance.

It is yet another object of the present invention to provide such a training device that encourages and assists the novice hockey player to concentrate and focus attention on the skates and stick of the opponent.

It is a further object of the present invention to provide such a training device that further includes a braking or drag mechanism, such as adjustable spikes, on the bottom edge of the skate-like elements.

It is a further object of the present invention to provide a support plate or post on the training device suitable for supporting a weight, such as one or more bags of sand or lifting weights commonly used in gyms.

These and such other objects of the invention as will become evident from the disclosure below are met by the invention disclosed herein. In addition to the explicitly claimed method and apparatus described herein, as such, it is to be understood that all new and useful devices or components described herein arc considered to constitute a part of the invention, claimable in their own right, whether such is stated with particularity herein or not.

BEST MODE OF CARRYING OUT THE INVENTION

Figure 1:
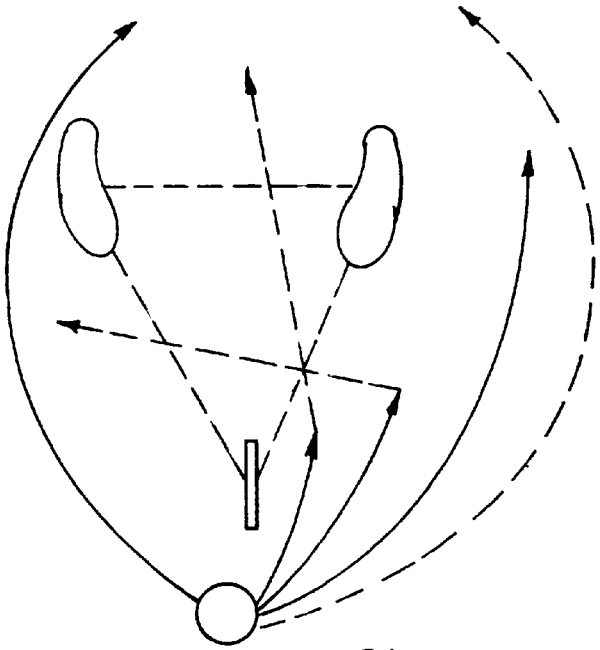
FIG. 1 schematically illustrates the hockey skill of attacking the triangle that the present invention assists in training.

Turning now to the drawings, the invention will be described in a preferred embodiment by reference to the numerals of the drawing figures wherein like numbers indicate like parts.

As illustrated in FIG. 1, a hockey player handling the puck, has several options when attempting to maneuver the puck past an opposing player. The opposing player presents an obstacle to the puck consisting of the opponents skates and stick, which normally define a triangular region generally underneath the opponent. Therefore the puck-handling player may attempt to bring the puck around this triangular region on either side, or through the triangular region, passing between the opponents skates or between the opponents toes and the heel of the opponents stick. This ability to maneuver the hockey puck past an opponent is one of the basic skills associated with the sport of hockey.

Figure 2:
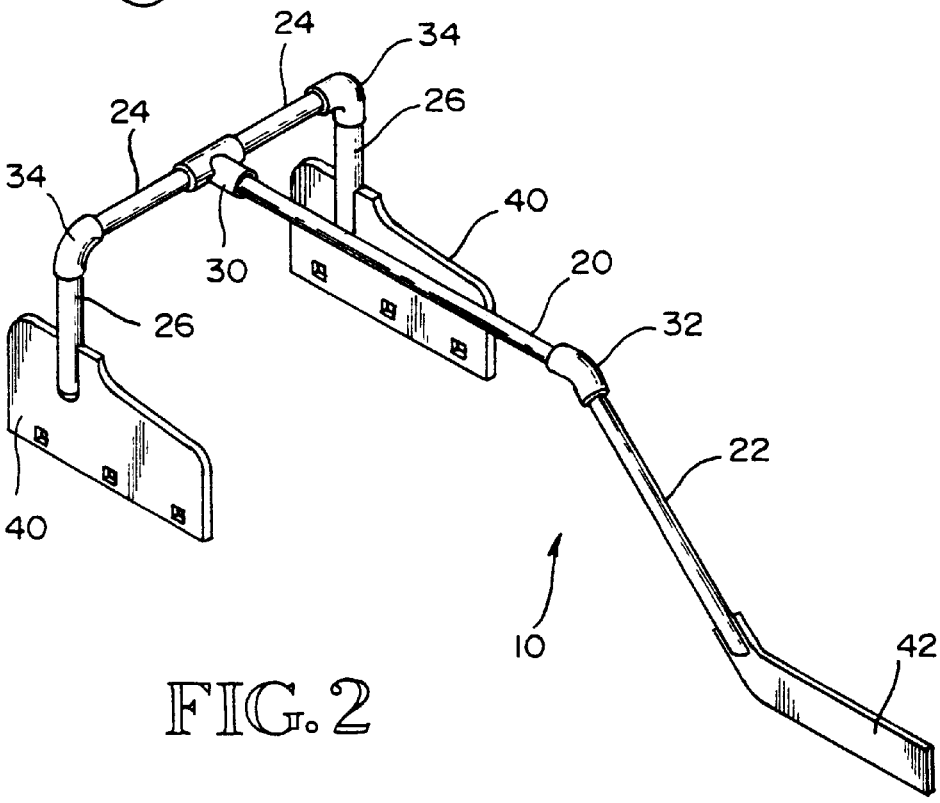
FIG. 2 is a perspective view of one embodiment of the present invention.
Figure 3:
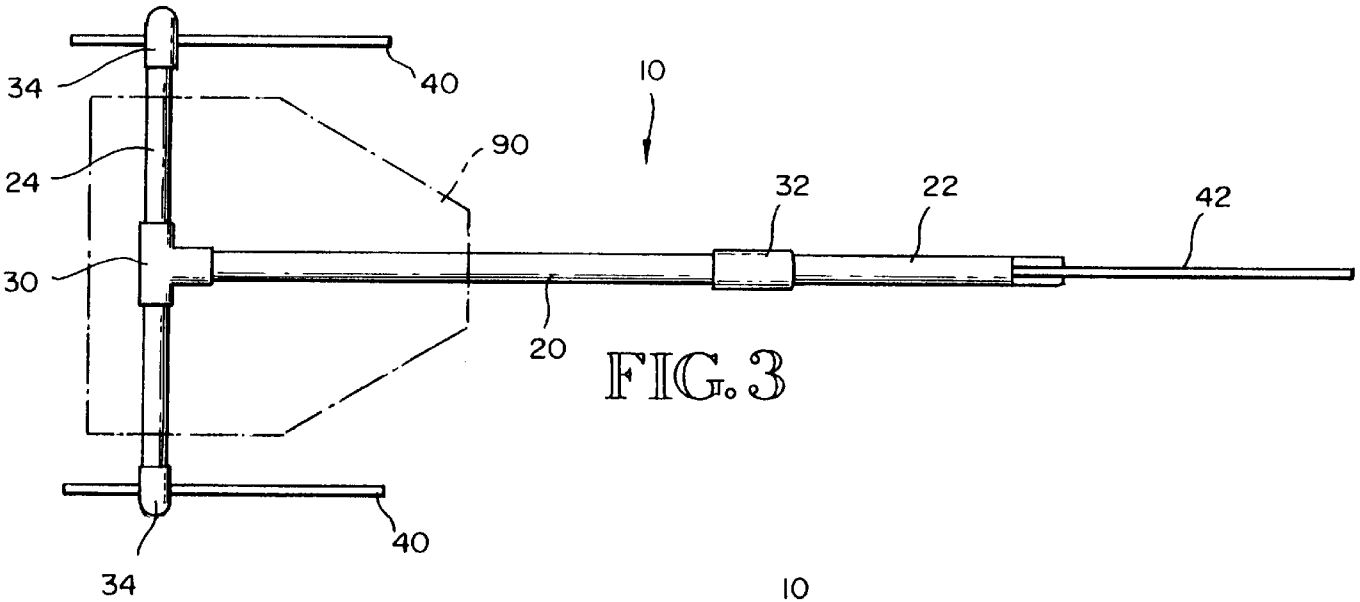
FIG. 3 is a plan view of the device of FIG. 2.
Figure 4:
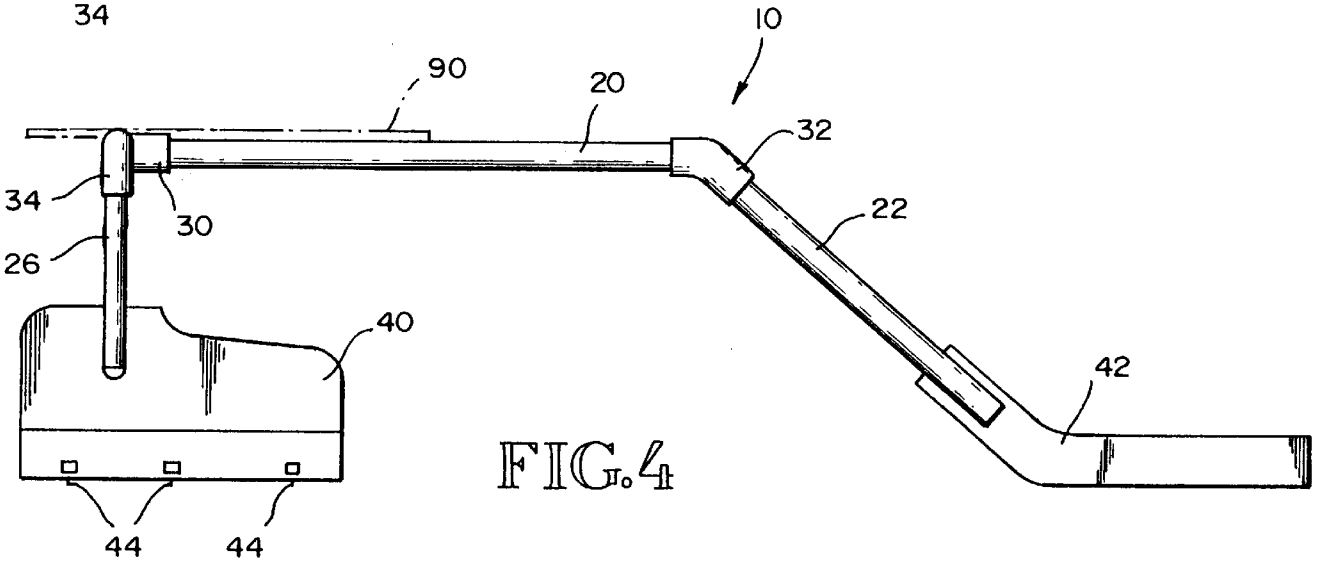
FIG. 4 is a elevation view of the device of FIG. 2.
Figure 5:
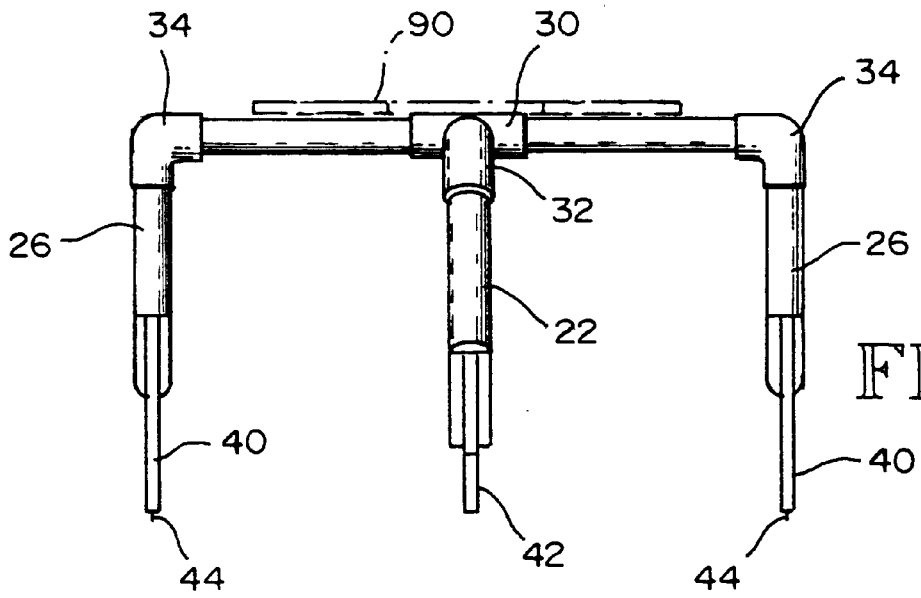
FIG. 5 is a front view of the device of FIG. 2.

As shown in FIGS. 2 though 5, the present invention provides a training device that roughly simulates the triangular region beneath an opponent, as described above. In the preferred embodiment, the device consists of a T-shaped tubular frame consisting of a longitudinal tubular member 20 connecting to a transverse member 24 through a T-connector 30. In the preferred embodiment the transverse member 24 is a single tubular member slidably inserted into the T-connector 30. It is also contemplated that alternatively one end of each of two shorter tubular members may be connected individually to either side of T-connector 30. The assembled transverse member 24 has a first and second end, equally disposed on either side of, and perpendicular to, the longitudinal member 20.

The first and second end of the transverse member 24 are each attached to a tubular leg member 26 downwardly disposed from, and generally perpendicular to the transverse member 24 and to longitudinal member 20, through 90 degree elbow connectors 34. The other end of the tubular leg members 26 have connecting thereto parallel skate-like members 40 to simulate the feet and skates of an opponent. In the preferred embodiment the skate-like members have a cylindrically-shaped upper end sized to fit inside tubular leg members 26. When the device is assembled, the parallel skate-like members 40 are approximately 18 inches apart, and have a bottom edge that is approximately 12 inches long, approximating a typical size and spacing for the skates of a hockey player.

The end of the longitudinal tubular member 20 farthest from the transverse member 24 connects to a downwardly disposed tubular leg member 22 by a preferably 45 degree in-line connector 32. The other end of tubular leg member 22 is connected to a hockey stick-like member 42 simulating the bottom section of an opponent's hockey stick. In the preferred embodiment the stick-like member has a cylindrically-shaped upper end sized to fit inside tubular leg member 22. The heal of the stick-like member 42 in the preferred embodiment is approximately 24 inches in front of, and approximately centered on, the forward edge of the skate-like members 40, approximating a typical hockey stick placement of an opposing hockey player.

A plate or saddle 90 to support a weighting means, such as a fifty pound bag of sand, may optionally be attached to the top of the frame, connecting to both the longitudinal member 20 and the transverse member 24. Alternatively, a metal post (not depicted) sized to accommodate disk-shaped gym weights of the type having a center hole, may be attached to the frame, preferable near the T-connector 30.

In the preferred embodiment the longitudinal tubular member 20, transverse tubular member 24, tubular leg members 22, 26 and connectors 30, 32, 34 are made from standard steel piping components. It will be appreciated that a lighter duty and less expensive embodiment of the present invention could also be made from standard ABS piping components. The stick-like member 42 and skate-like members 40 may be fabricated from a variety of suitably sturdy plastic materials. For a more realistic training experience the stick-like member 42 may be made from the end of an actual hockey stick, and the skate-like members could include steel hockey skate blades.

Figure 6:
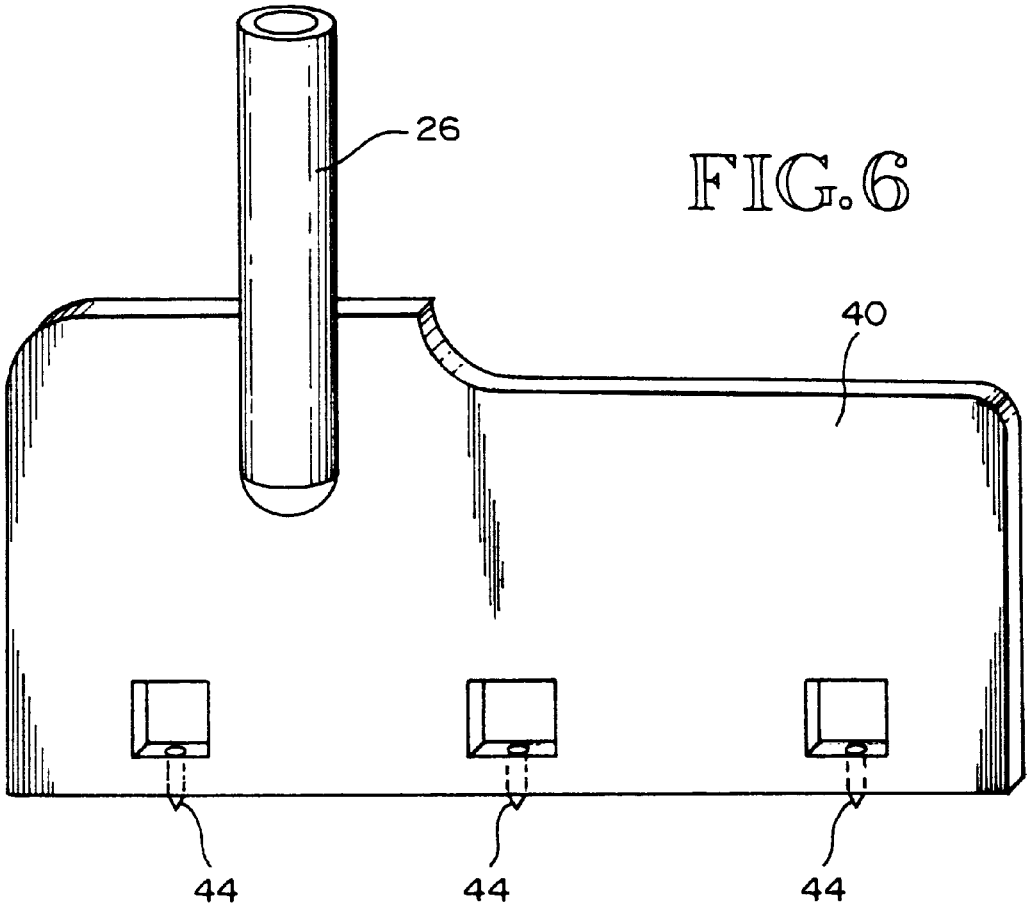
FIG. 6 is a perspective view of the skate-like elements showing the drag devices on the preferred embodiment.

An additional feature in the preferred embodiment are adjustable braking or drag elements 44 projecting downwardly from the skate-like elements 40, as can best be seen in FIG. 6. The drag elements 44 in the preferred embodiment comprise a plurality of threaded cylindrical metal set-screws having a conical lower end. The drag elements 44 impede the sliding of the training device 10 and will even cause the device to bounce or jump when struck, more closely simulating possible motion of a hockey opponent. The amount of drag induced by the drag elements 44 may be adjusted by increasing or decreasing the portion of the elements that project from the edge of the skate-like elements 40. The effectiveness of the drag elements 44 will also be affected by the amount of weight placed on the plate or saddle support 90, or alternatively, the metal post.

It should be understood to one of skill in the art that a wide range of changes and modifications may be made to the preferred embodiment described above. For example, non-tubular members, such as wood or plastic lumber may be substituted for the tubular members. Other frame shapes would be obvious, including triangular and rectangular frames. Actual hockey skates or a hockey stick may be used for the skate-like and stick-like members of the preferred embodiment. The additional weight, when desired, could be added in a permanent fashion, for example by filling the tubular members with a high-density material. It would also be obvious to one of ordinary skill in the art to configure the training device to be foldable, for easy storage. It would also be obvious to incorporate adjustable spacing of the skate and stick members, allowing the trainee to hone their skills over time by decreasing the target size. It is also contemplated that the longitudinal tubular member 20 or alternatively the leg 22 connecting to the stick-like member 42 could be made to pivot, changing its angle and the location of the stick-like member 42 with respect to the skate-like members 40. The motion of the stick-like member 42 could be motorized to allow the novice to practice maneuvering a hockey puck around or through a moving target. These, and other modifications to the preferred embodiment would be obvious to one of ordinary skill. Therefore, it is intended that the foregoing detailed description be regarded as illustrative, rather than limiting, and that it be understood that it is the following claims, including all equivalents, which are intended to define the protected scope of this invention.

I claim:

1. A hockey training device, comprising:

(a) a frame having first, second and third frame ends;

(b) three support legs comprising:

(i) a first support leg having a proximal end and a distal end, said proximal end connecting to said first frame end;

(ii) a second support leg having a proximal end and a distal end, said proximal end connecting to said second frame end; and (iii) a third support leg having a proximal end and a distal end said proximal end connecting to said third frame end;

each of said first, second and third support legs extending outwardly from one side of a plane defined by said frame;

(c) two skate simulation members comprising:

(i) a first skate simulation member connecting to said distal end of said first support leg, said first skate simulation member having a first elongated straight edge; and (ii) a second skate simulation member connecting to said distal end of said second support leg, said second skate simulation member having a second elongated straight edge; and (d) at least one ice engaging drag member projecting downwardly from each of said first and second elongated straight edges of said first and second skate simulation members, said drag member preventing motion of said skate simulation members in any direction.

(e) a hockey stick member connecting to said distal end of said third support leg, said hockey stick member having a third elongated straight edge;

said hockey training device assembled so that said first, second and third elongated straight edges are coplanar and are triangularly disposed.

2. The hockey training device of claim 1 wherein said drag members comprise threaded screw-like members that may be adjusted to change the distance said pointed drag members project downwardly from said elongated straight edges.

3. The hockey training device of claim 1 further comprising a support plate means attached to said frame capable of supporting at least one bag of sand.

4. The hockey training device of claim 1 wherein said first and second support legs project vertically downward from said frame thereby simulating the bottom of the legs of an opposing hockey player, and said third support leg projects downwardly at an angle forward of said first and second support legs thereby simulating the hockey stick of said opposing hockey player.

5. A method for training ice hockey players to maneuver a hockey puck past opponents that encourages the trainee to concentrate on the triangle at the ice surface formed by the opponents skates and stick, said method comprising the steps of placing an apparatus on the ice a short distance in front of said ice hockey player, said apparatus resting on integral skate and stick simulation means arranged in a triangular configuration, equipping said ice hockey player with a hockey stick and puck, and directing said hockey player to repeatedly maneuver said hockey puck with said hockey stick through any two sides of said triangle formed by said apparatus.

* * * * *